US006224351B1

(12) United States Patent
Simon et al.

(10) Patent No.: US 6,224,351 B1
(45) Date of Patent: May 1, 2001

(54) RADIAL PISTOL PUMP

(75) Inventors: Hans-Juergen Simon, Bad Liebenzell; Bernd Streicher, Filderstadt, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/394,886

(22) Filed: Sep. 13, 1999

(30) Foreign Application Priority Data

Sep. 11, 1998 (DE) ..... 198 41 642

(51) Int. Cl.[7] ..... F04B 27/04
(52) U.S. Cl. ..... 417/273; 417/568
(58) Field of Search ..... 417/568, 273

(56) References Cited

U.S. PATENT DOCUMENTS 3,779,225 * 12/1973 Watson et al. ..... 123/139 E
4,140,440 * 2/1979 Ferris ..... 417/343
4,395,990 * 8/1983 Hofer et al. ..... 123/502
4,489,698 * 12/1984 Hofer et al. ..... 123/502
5,382,140 * 1/1995 Eisenbacher et al. ..... 417/473
5,820,358 * 10/1998 Kushida et al. ..... 417/420
5,979,297 * 11/1999 Ricco ..... 92/129
6,139,284 * 10/2000 Streicher ..... 417/273

* cited by examiner

*Primary Examiner*—Charles G. Freay
*Assistant Examiner*—Ehud Gartenberg
(74) *Attorney, Agent, or Firm*—Ronald E. Greigg; Edwin E. Greigg

(57) ABSTRACT

A radial piston pump for high-pressure fuel delivery in fuel injection systems of internal combustion engines, particularly in a common rail injection system. A drive shaft is supported in a pump housing and is embodied as eccentric or has cam-like projections in the circumference direction. A number of pistons are each disposed in a respective element bore and are situated radially in relation to the drive shaft. The pistons can be set into a reciprocating motion in the radial direction inside the respective element bore through the rotation of the drive shaft in order to aspirate fuel by way of an intake conduit in which an intake valve is disposed. The fuel is aspirated into a cylinder chamber that is defined by the piston in the element bore and is connected to a high-pressure conduit in which a high-pressure valve is disposed. The element bore is disposed together with the intake conduit and the high-pressure conduit in an element head. The embodiment of the element bore as a blind hole from which the intake conduit and the high-pressure conduit lead achieves a reduction of the high-pressure sealing points.

5 Claims, 2 Drawing Sheets

RADIAL PISTOL PUMP

BACKGROUND OF THE INVENTION

The invention relates to a radial piston pump for high-pressure fuel delivery in fuel injection systems of internal combustion engines, particularly in a common rail injection system. A drive shaft is supported in a pump housing and is embodied as eccentric or has cam-like projections in the circumference direction, and preferably has a number of pistons that are each disposed in a respective element bore. The pistons are situated radially in relation to the drive shaft, and can be set into a reciprocating motion in the radial direction inside the respective element bore through the rotation of the drive shaft in order to aspirate fuel by way of an intake conduit in which an intake valve is disposed, into a cylinder chamber that is defined by the piston in the element bore and is connected to a high-pressure conduit in which a high-pressure valve is disposed, wherein the element bore is disposed together with the intake conduit and the high-pressure conduit in an element head.

A radial piston pump of this kind is known from DE 42 13 798 A1. With the known radial piston pump, the high number of high-pressure sealing points has turned out to be disadvantageous.

OBJECT AND SUMMARY OF THE INVENTION

An object of the current invention is to reduce the number of high-pressure sealing points in the known radial piston pump. The radial piston pump according to the invention should withstand a pump-side peak pressure of up to 2000 bar. In addition, the radial piston pump according to the invention should be inexpensive to manufacture.

In a radial piston pump for high-pressure fuel delivery in fuel injection systems of internal combustion engines, particularly in a common rail injection system. A drive shaft is supported in a pump housing and is embodied as eccentric or has cam-like projections in the circumference direction. A number of pistons that are each disposed in a respective element bore, are situated radially in relation to the drive shaft, and can be set into a reciprocating motion in the radial direction inside the respective element bore through the rotation of the drive shaft in order to aspirate fuel by way of an intake conduit in which an intake valve is disposed. The fuel is aspirated into a cylinder chamber that is defined by the piston in the element bore and is connected to a high-pressure conduit in which a high-pressure valve is disposed. The element bore is disposed together with the intake conduit and the high-pressure conduit in an element head, an object is attained by virtue of the fact that the element bore is embodied in the element head as a blind bore from which the intake conduit and the high-pressure conduit lead. The embodiment of the element head as a blind hole element head reduces the number of high-pressure sealing points in comparison to the known radial piston pump. The simple construction also reduces the number of individual parts required. In the embodiment according to the invention, the soft seal concept can be eliminated in the high-pressure region. This produces a very high degree of functional reliability.

Furthermore, the element head of the radial piston pump according to the invention can be separately tested with a hydraulic ram. Another advantage arises from the fact that the element head can be pre-assembled as a subassembly. The pre-assembled element head can be mounted on the housing in a simple manner. This results in a very high degree of process reliability during assembly. An additional advantage lies in that the invention can be transferred to the known radial piston pump without fundamentally changing the housing concept.

A particular embodiment of the invention is characterized in that the intake conduit and the high-pressure conduit are disposed essentially perpendicular to the element bore. This simplifies the positioning of tools during manufacturing. The assembly is also simplified.

Another particular embodiment of the invention is characterized in that the intake conduit and the high-pressure conduit are flush with one another. This produces a further simplification in the production of the radial piston pump according to the invention. A part of the intake conduit and of the high-pressure conduit can be produced by means of a single bore which extends perpendicular to the element bore.

Another particular embodiment of the invention is characterized in that two bores are provided in the element head for the high-pressure valve and for the intake valve and these bores are flush with one another as well as with the intake conduit and the high-pressure conduit. This results in a simple, symmetrical design of the element head of the radial piston according to the invention.

The invention will be better understood and further objects and advantages thereof will become more apparent from the ensuing detailed description of preferred embodiments taken in conjunction with the drawings. The features mentioned in the claim and in the description can be essential to the invention by themselves or in arbitrary combinations.

DESCRIPTION OF THE PREFERRED EMBODIMENTS

Figure 1:
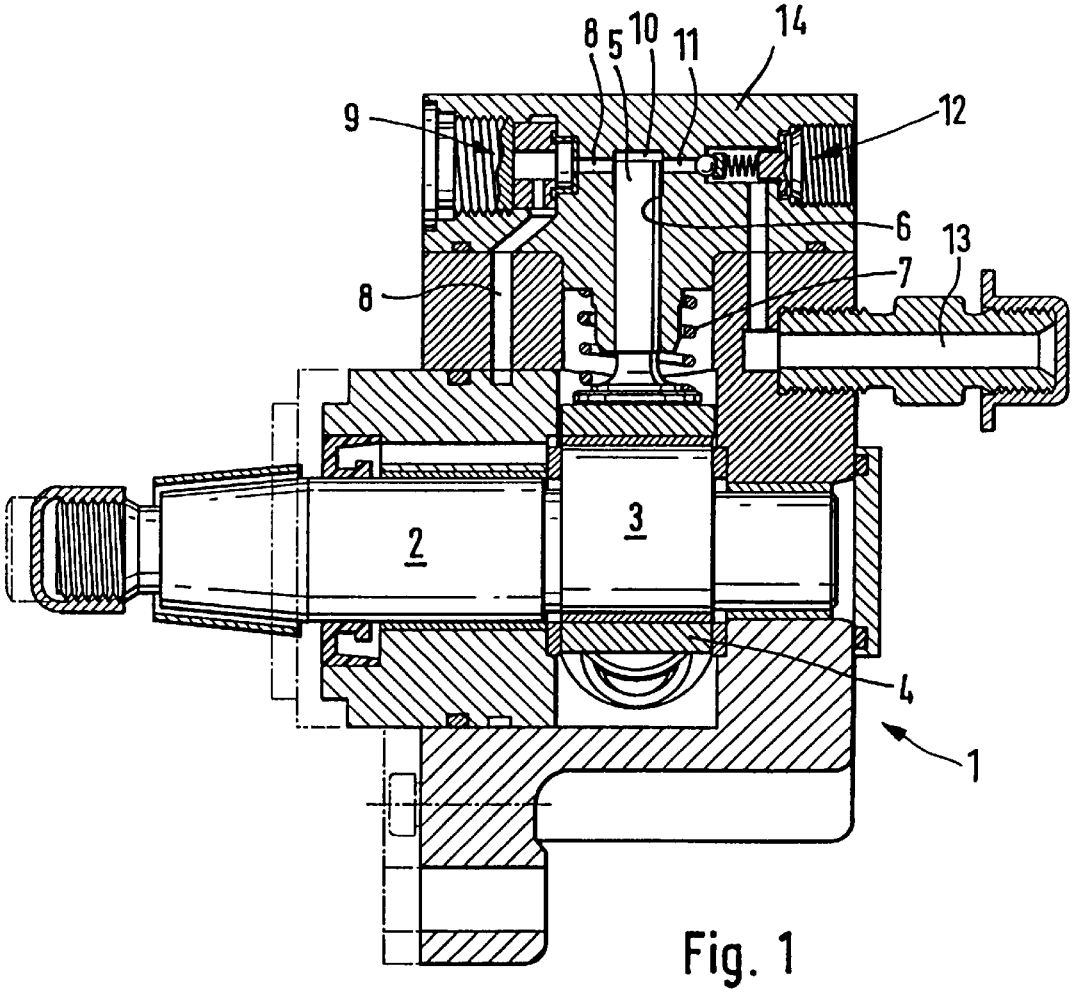
FIG. 1 is a section lengthwise to the drive shaft of a radial piston pump according to the invention.

FIG. 1 is a section through a radial piston pump for high-pressure fuel delivery in fuel injection systems of internal combustion engines. The radial piston pump shown in FIG. 1 is used in particular in common rail injection systems for supplying fuel to diesel engines. In this connection, common rail means the same thing as common line. In contrast to conventional high-pressure injection systems, in which fuel is supplied to the individual combustion chambers via separate lines, the unit fuel injectors in common rail injection systems are supplied from a common line.

The radial piston pump shown in FIG. 1 includes a drive shaft 2, which is supported in a pump housing 1 and has an eccentrically embodied shaft section 3. A polygon ring 4 is supported on the eccentric shaft section 3 and the shaft section 3 can be rotated in relation to the ring. The polygon ring 4 contains three flattenings that are offset from one another by 120°, against which the pistons 5 are respectively supported. The pistons, of which only the piston 5 can be seen in the sectional view shown in FIG. 1, are each contained in an element bore 6 so that they can reciprocate in the radial direction in relation to the drive shaft 2. A plate-shaped foot is embodied on the end of the piston 5 oriented toward the drive shaft 2. A spring 7 is pre-stressed against the plate-shaped foot. The spring 7 presses the piston 5 against the eccentric shaft section 3 of the drive shaft 2 or against the polygon ring 4 that is supported on it.

The radial piston pump shown in FIG. 1 is used to exert high pressure on fuel that is supplied from a tank by a pre-feed pump. When aspirated, the fuel travels by way of an intake conduit 8 in which an intake valve 9 is disposed, into a cylinder chamber 10. The fuel aspirated into the cylinder chamber 10 has high pressure exerted on it by the piston 5 and then travels by way of a high-pressure conduit 11 in which a high-pressure valve 12 is disposed, to a common high-pressure connection 13. The common high-pressure connection 13 then leads to the rail.

Figure 2:
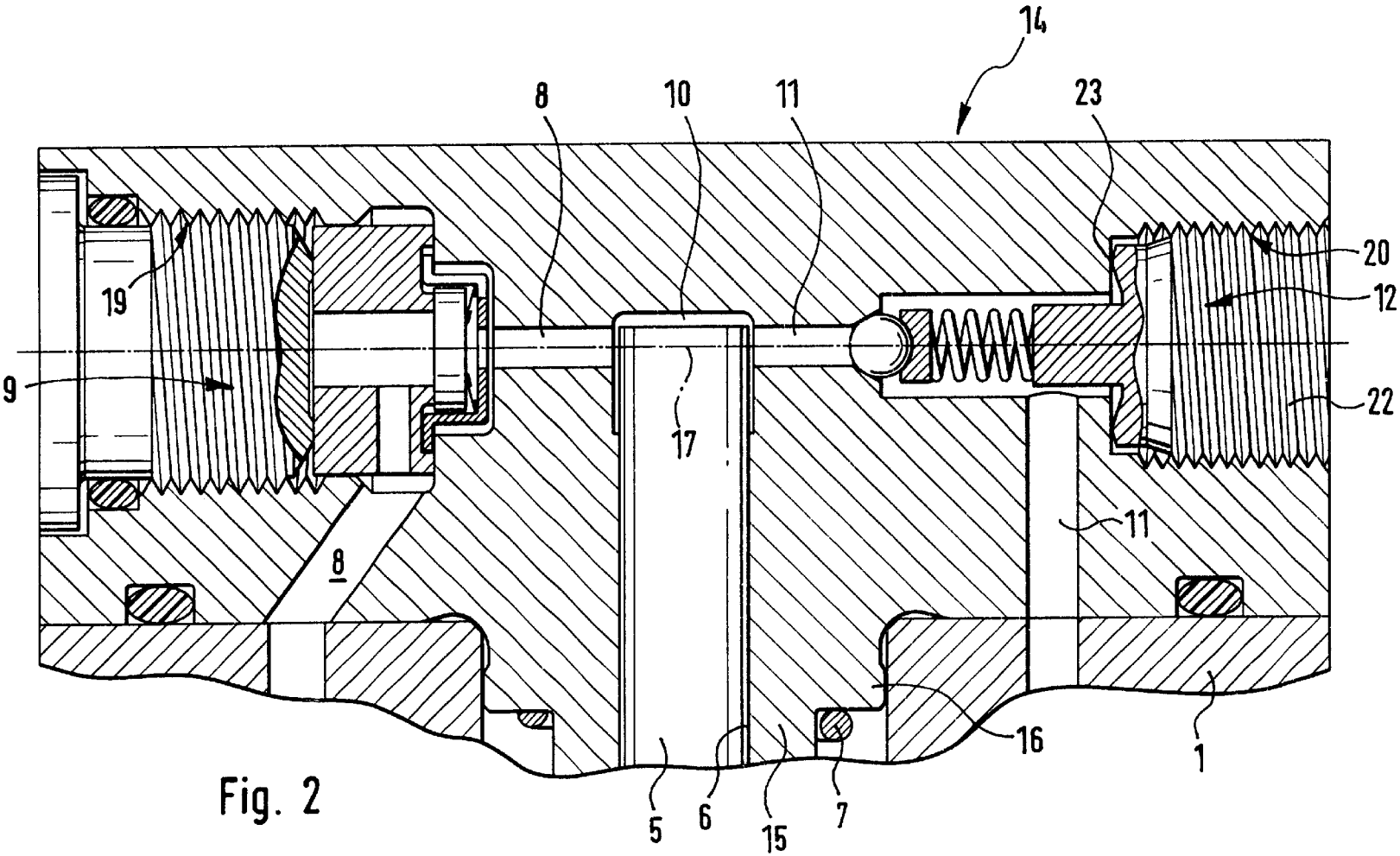
FIG. 2 is an enlarged depiction of the element head from FIG. 1.

From the enlarged view of a detail from FIG. 1 that is shown in FIG. 2, it is clear that the intake conduit 8, the element bore 6, and the high-pressure conduit 11 are disposed in an element head that is labeled as a whole with the number 14.

The element head 14 has the shape of a block from which a cylindrical projection 15 protrudes. A centering collar 16 is embodied on the cylindrical projection 15. The centering collar 16 simultaneously constitutes a stop for the spring 7.

The element bore is embodied as a blind hole in the element head 14. The intake conduit 8 and the high-pressure conduit 11 feed in at diametrically opposed points at the end of the element bore 6. The intake conduit 8 and the high-pressure conduit 11 are constituted by a single bore along an axis 17, which is perpendicular to the longitudinal axis of the element bore 6.

The bore that constitutes the intake conduit 8 and the high-pressure conduit 11 is bored in step fashion toward the outside. The sections thus formed, with a diameter that increases toward the outside, make room for the intake valve 9 and the high-pressure valve 12. A biting edge 23 is embodied on a stopper 22 for the high-pressure valve 12.

The foregoing relates to preferred exemplary embodiments of the invention, it being understood that other variants and embodiments thereof are possible within the spirit and scope of the invention, the latter being defined by the appended claims.

We claim:

1. A radial piston pump for high-pressure fuel delivery in fuel injection systems of internal combustion engines including a common rail injection system, comprising a drive shaft (2) that is supported in a pump housing (1), said drive shaft is embodied as eccentric or has cam-like projections in the circumference direction, a number of pistons (5) that are each disposed in a respective element bore (6) are situated radially in relation to the drive shaft (2), the pistons can be set into a reciprocating motion in the radial direction inside the respective element bore (6) through the rotation of the drive shaft (2) in order to aspirate fuel by way of an intake conduit (8) in which an intake valve (9) is disposed, fuel is aspirated into a cylinder chamber (10) that is defined by the piston (5) in the element bore (6) and is connected to a high-pressure conduit (11) in which a high-pressure valve (12) is disposed, the element bore (6) is disposed together with the intake conduit (8) and the high-pressure conduit (11) in an element head (14), the element bore (6) in the element head (14) is embodied as a blind bore, from which the intake conduit (8) and the high-pressure conduit (11) lead, and the intake conduit (8) and the high-pressure conduit (11) are directly connected to the pump housing.

2. The radial piston pump according to claim 1, in which the intake conduit (8) and the high-pressure conduit (11) are disposed essentially perpendicular to the element bore (6).

3. The radial piston pump according to claim 2, in which the intake conduit (8) and high-pressure conduit (11) are flush with one another.

4. The radial piston pump according to claim 3, in which two bores (19, 20) are provided for the high-pressure valve (9) and the intake valve (12) in the element head (14) and these bores are flush with each other as well as with the intake conduit (8) and the high-pressure conduit (11).

5. A radial piston pump for high-pressure fuel delivery in fuel injection systems of internal combustion engines, particularly in a common rail injection system, consisting of: at least one head (14), each of which includes a bore (6), an input conduit (8), and a high-pressure conduit (11); a drive shaft (2) that is supported in a pump housing (1) and has at least one portion that is eccentric in the circumferential direction; at least one piston (5) that is disposed in a respective bore (6) and is situated radially in relation to the drive shaft (2) to engage the eccentric portion; at least one inlet valve that is disposed within a respective input conduit; and at least one high-pressure valve which is disposed within a respective high pressure conduit, wherein each piston can be set into a reciprocating motion in the radial direction inside its respective bore (6) through the rotation of the drive shaft (2) in order to aspirate fuel by way of the respective intake conduit (8) and intake valve (9) into a cylinder chamber (10) that is defined by the piston (5) in the respective bore (6), and to expel fuel through the respective high-pressure conduit (11) and high-pressure valve (12), the bore (6) in each head (14) is embodied as a blind bore from which the respective intake conduit (8) and the high-pressure conduit (11) lead, and the intake conduit (8) and the high-pressure conduit (11) are directly connected to the pump housing (1).

* * * * *